US005773772A

United States Patent [19]

McCarthy et al.

[11] Patent Number: 5,773,772

[45] Date of Patent: Jun. 30, 1998

[54] TRANSFERRING ELEVATOR CABS BETWEEN NON-CONTIGUOUS HOISTWAYS

[75] Inventors: Richard C. McCarthy, Simsbury; Joseph Bittar, Avon; Frederick H. Barker, Bristol; Bruce A. Powell, Canton; Samuel C. Wan, Simsbury; Paul Bennett, Waterbury; Anthony Cooney, Unionville; John K. Salmon, deceased, late of South Windsor, all of Conn., by LucyMary Salmon, legal representative

[73] Assignee: Otis Elevator Company, Farmington, Conn.

[21] Appl. No.: 666,162

[22] Filed: Jun. 19, 1996

[51] Int. Cl.[6] ..... B66B 9/00; B66B 1/06

[52] U.S. Cl. ..... 187/289; 187/401; 187/249

[58] Field of Search ..... 187/401, 402, 187/249, 282, 289

[56] References Cited

U.S. PATENT DOCUMENTS

| | | | |
|---|---|---|---|
| 1,939,729 | 12/1933 | Stark | 187/1 |
| 2,052,690 | 9/1936 | Austin | 187/249 |
| 5,090,515 | 2/1992 | Takahashi et al. | 187/249 |
| 5,601,156 | 2/1997 | McCarthy et al. | 187/249 |

FOREIGN PATENT DOCUMENTS

| | | | |
|---|---|---|---|
| 3-272987 | 12/1991 | Japan | 187/289 |
| 3-279186 | 12/1991 | Japan | 187/289 |
| 4-153187 | 5/1992 | Japan . | |
| 5-162947 | 7/1993 | Japan | 187/289 |
| 6-9175 | 1/1994 | Japan | 187/289 |
| 6-156939 | 6/1994 | Japan | 187/289 |

*Primary Examiner*—Robert Nappi

[57] ABSTRACT

A plurality of express shuttle elevators S1–S4 exchange elevator cabs at a transfer floor 26 with local elevators L1–L10 by means of a carriage 107, the casters of which 93 are guided by tracks 70–83. The transfer floor has linear induction motor (LIM) primary segments 60–67 disposed on the transfer floor; the carriage has a LIM secondary 128 thereon for propulsion. The carriages can be locked 91, 92 to the transfer floor for loading, and cabs can be locked 131 onto the carriages for stability when being moved. A controller (FIGS. 10–13) keeps track of the progress of the cabs from one elevator to another.

29 Claims, 12 Drawing Sheets

FIG.3
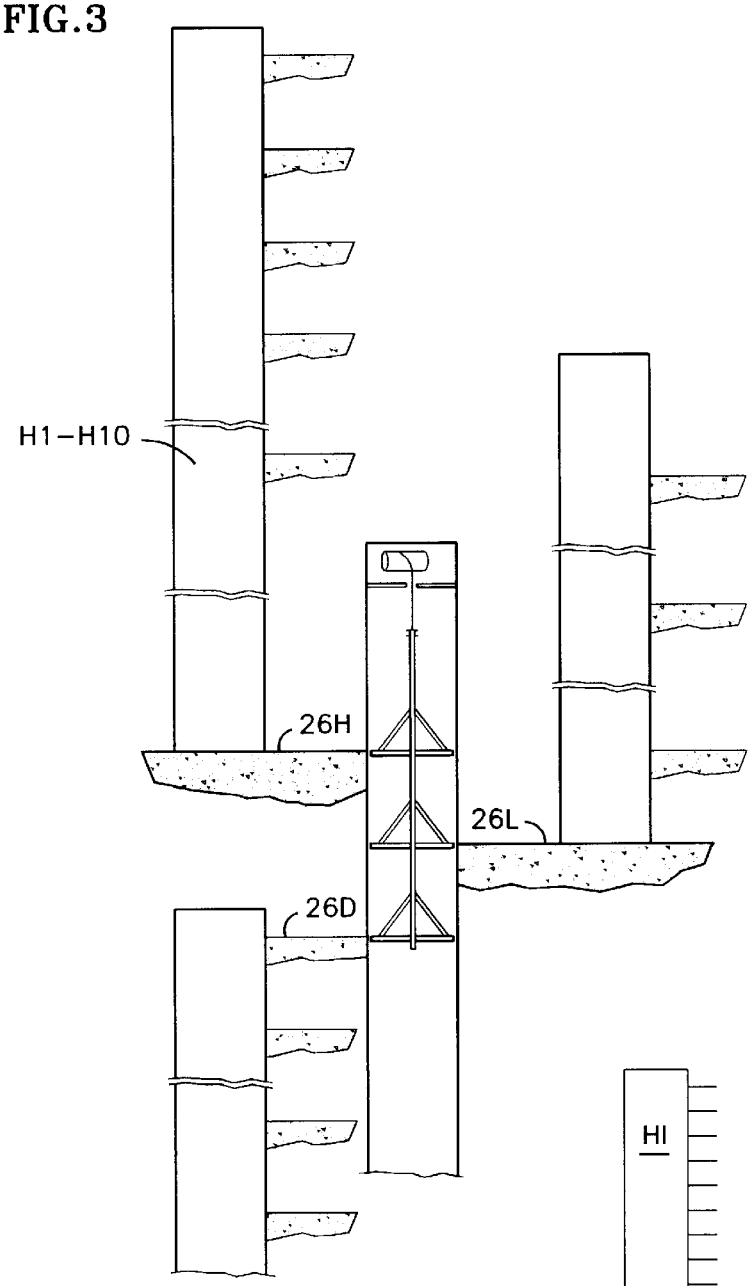
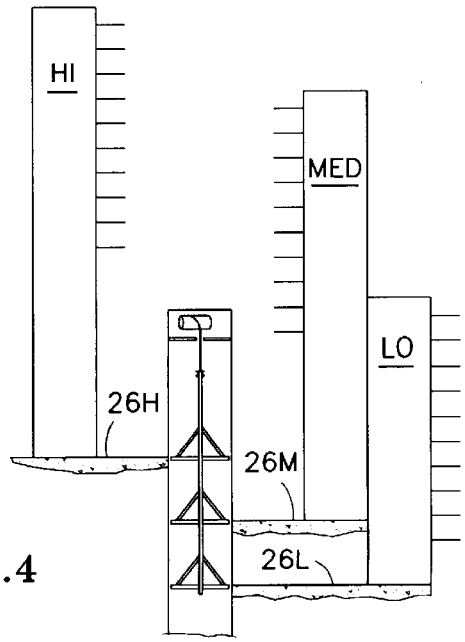
FIG.4

TRANSFERRING ELEVATOR CABS BETWEEN NON-CONTIGUOUS HOISTWAYS

TECHNICAL FIELD

This invention relates to transferring elevator cabs between hoistways of one group of elevators and the hoistway of another elevator not contiguous with a hoistway in said one group.

BACKGROUND ART

In order to extend the useful height of roped elevator systems in very tall buildings, and to utilize each elevator hoistway more effectively in carrying passengers, a recent innovation is transferring a cab between overlapping elevator shafts, and more particularly, exchanging a pair of cabs between elevator shafts. Elevators of this type are variously disclosed in commonly owned U.S. patent application Ser. Nos. 08/564,754; 08/564,534; 08/565,606; 08/564,703; all filed on Nov. 29, 1995, and Ser. No. 08/588,577 filed on Jan. 18, 1996. In each of these systems, carframes, between which elevator cabs are transferred, are disposed in hoistways that are contiguous with one another, so that an elevator cab can be transferred directly from one car frame in a first hoistway to another car frame in a contiguous, second hoistway.

The foregoing systems provide a significant improvement in the utilization of building space for elevators, that becomes particularly aggravated in very tall buildings in which a bulk of passenger traffic must travel upwardly through the lower floors. However, should one elevator of a set of two or more such related elevators become disabled, the entire shaft space becomes useless during the disablement. There is no capability to utilize the lowermost elevator of one shaft space or shuttle with an upper elevator of another shaft space or shuttle should each of them have disabled portions.

DISCLOSURE OF INVENTION

Objects of the invention include moving elevator cabs between elevator car frames disposed in non-contiguous hoistways, including exchanging a pair of cabs between such hoistways and transferring an elevator cab from any one of a group of elevators to another elevator.

According to the present invention, elevator cabs are moved between non-contiguous hoistways by a carrier which travels between the hoistways.

According to the invention, a pathway interconnects a group of elevators with another elevator. According to the invention further, carrier paths are disposed to allow a pair of cab-carrying carriers to pass each other while exchanging cabs between hoistways. In accordance with the invention, the carrier may be propelled by a LIM, the primary of which may be disposed in the paths on a transfer floor. According to the invention, a carrier may be moved between selected hoistways on a plurality of intersecting paths; the paths may be orthogonal to each other. In accordance with the invention further, the paths may include wheel tracks, and the wheel tracks may have portions of a LIM disposed therebetween. According to the invention, the carrier may be passive, but it need not be.

The invention permits motion of cabs between non-contiguous, and therefore non-committed hoistways in a random fashion. The invention gives rise to the capability to transfer an elevator cab from a selected one of a first group of elevators to a selected one of a second group of elevators.

The invention allows exchanging elevator cabs between selected elevators of opposing groups substantially simultaneously, due to a configuration which allows one cab to pass another en route between elevators of the different groups.

In an embodiment of the invention, a linear induction motor powering system comprises a wheeled carriage with a cross-shaped linear induction motor secondary disposed thereon operating above a network of linear induction motor primaries disposed in orthogonal paths on a transfer floor of a building across which elevator cabs are to be transported.

Other objects, features and advantages of the present invention will become more apparent in the light of the following detailed description of exemplary embodiments thereof, as illustrated in the accompanying drawing.

BRIEF DESCRIPTION OF THE DRAWINGS

FIG. 3 is a partial, partially sectioned, stylized side elevation view of a third elevator system having a triple deck shuttle feeding a low rise elevator group, a high rise elevator group, and a downwardly extending local elevator group, which may employ the present invention.

FIG. 4 is a simplified, partial, partially sectioned, stylized side elevation view of a fourth elevator system having a triple deck shuttle feeding a low rise elevator group, a medium rise elevator group, and a high rise elevator group, which may employ the present invention.

BEST MODE FOR CARRYING OUT THE INVENTION

Figure 1:
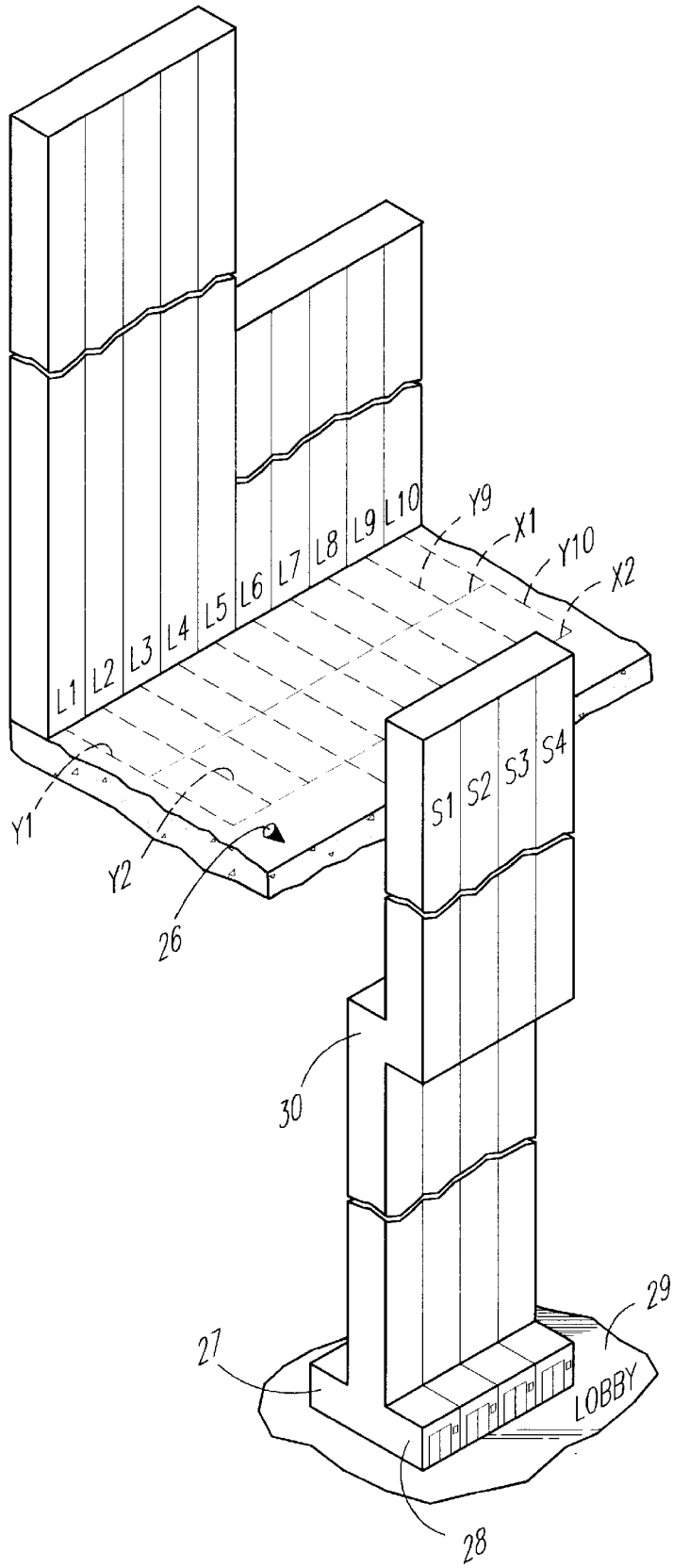
FIG. 1 is a simplified, stylized, perspective view of a bank of two-shaft elevator shuttle systems with off-shaft loading and unloading, serving a larger bank of local elevators including high rise and low rise, at the high end of a building, between which elevator cabs may be moved across an interposed transfer floor, in accordance with the invention.

Referring now to FIG. 1, an elevator installation comprises a plurality of elevator shuttles S1–S4 which exchange cabs with a plurality of local elevators L1–L10 at a transfer floor 26. In the general embodiment of FIG. 1, the local elevators may all be low rise, with no express zones, or some, such as L1–L5 or more, might be high rise having express zones below the floor landings served thereby, in the conventional fashion. That is irrelevant to the invention, as can be seen in the following description. The shuttles in this embodiment are depicted as being of the type where cabs are placed at landings 27, 28, alternatively, at a lobby floor 29 for loading and unloading of passengers. In a case such as this, the car doors can be commanded to close at a time before the arrival of the car frame on which the car will be loaded, so the dispatching can be quite precisely controlled. In such a case, dispatching from the lobby 29 would be simple except for the fact that the car frame in the lower leg of a shuttle S1–S4 leaving the lobby 29 will want to reach a transfer floor 30 at the same time as a car frame in the upper leg of the shuttle, and the car frame at the transfer floor 26 will be scheduled to leave as soon as a cab is loaded on the car frame from one of the local elevators L1–L10. For this reason, the dispatching of car frames from the lobby 29 might indeed be controlled by the loading of a cab onto the related elevator car frame at the transfer floor 26.

On the other hand, in the embodiment of FIG. 1 there are advantageously a plurality of local elevators, principally because local elevators consume far greater amount of time than shuttle elevators to complete a round trip run, and that timing is truly random and sporadic. Therefore, it is possible to dispatch elevators from the lobby 29 without regard to the inflow of cabs at the transfer floor 26, selecting a local elevator with which to exchange cabs after a shuttle has left the lobby 29.

The transfer floor 26 is of the type described with respect to FIGS. 6 and 7, hereinafter. It includes a pair of linear induction motor (LIM) paths X1, X2 in a first (X) direction and a plurality of LIM paths Y1, Y2, . . . Y9 and Y10 orthogonal to the X paths. The dash lines in FIG. 2 denote the center of each path, which also comprises the positioning of the LIM primary on the transfer floor 26, used as motivation for a pair of cab carriers, such as described with respect to FIGS. 8 and 9, hereinafter, to transfer a cab from one of the local elevators L1–L10 to one of the shuttles S1–S4, simultaneously with transferring another one of the elevator cabs from one of the shuttles S1–S4 to the same one of the local elevators L1–L10 which is transferring a cab thereto. There is a pair of tracks for guiding the wheels of a cab carrier associated with each of the paths X1, X2, Y1–Y10.

The description thus far illustrates transfer between a pair of elevators in accordance with the invention. The invention may involve more than two elevators. Referring now to FIG. 23, a plurality of shuttles, S1–S4 each have a double deck car frame 31 which can deliver a low rise cab to a low rise transfer floor 26L for exchange with a low rise cab provided to the low rise transfer floor 26L by a plurality of low rise elevators L1–L10, and can similarly exchange cabs on a high rise transfer floor 26H with a plurality of high rise elevators H1–H10. Each of the transfer floors 26H, 26L is assumed in this embodiment to be identical to the transfer floor 26 of FIG. 1. The advantage of this embodiment is that the shuttle hoistways will carry two cabs at a time, instead of one, thereby much relieving the burden on core at the lower end of the building.

FIGS. 3 and 4 illustrate that even more local elevator groups can be serviced by a single elevator shuttle, such as a three decker serving three local elevator groups. In FIG. 3, one of the local elevator groups extends downwardly from a transfer floor D. In FIG. 4, the low rise transfer floor 26L is below and extends beyond a medium rise transfer floor 26M. In each of FIGS. 2–4, it is assumed that there is a lesser number of shuttles than locals, as illustrated in FIG. 1. Of course, the numbers can vary from the example herein.

Figure 2:
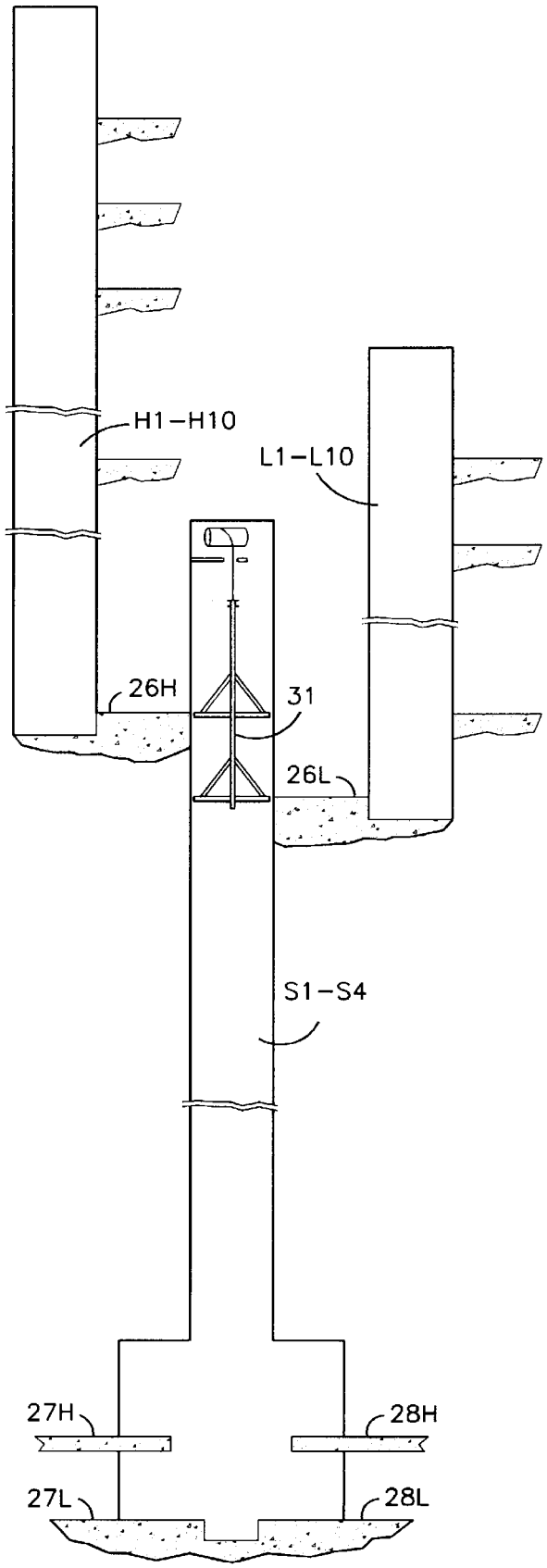
FIG. 2 is a partial, partially sectioned, stylized side elevation view of a second elevator system having a double deck shuttle feeding a low rise elevator group and a high rise elevator group which may employ the present invention.

To have an orderly movement of passengers upwardly and downwardly through the building, and to prevent passengers from having to wait at the transfer floor, in a closed, non-moving elevator cab, while waiting for either a local or a shuttle to which that cab can be transferred, control is provided to cause the shuttle to be matched up with an appropriate one of the locals, or several locals in the embodiments of FIGS. 2–4, and for the arrival times of the shuttle and one or more locals at the transfer floor or floors to be more nearly the same.

Figure 5:
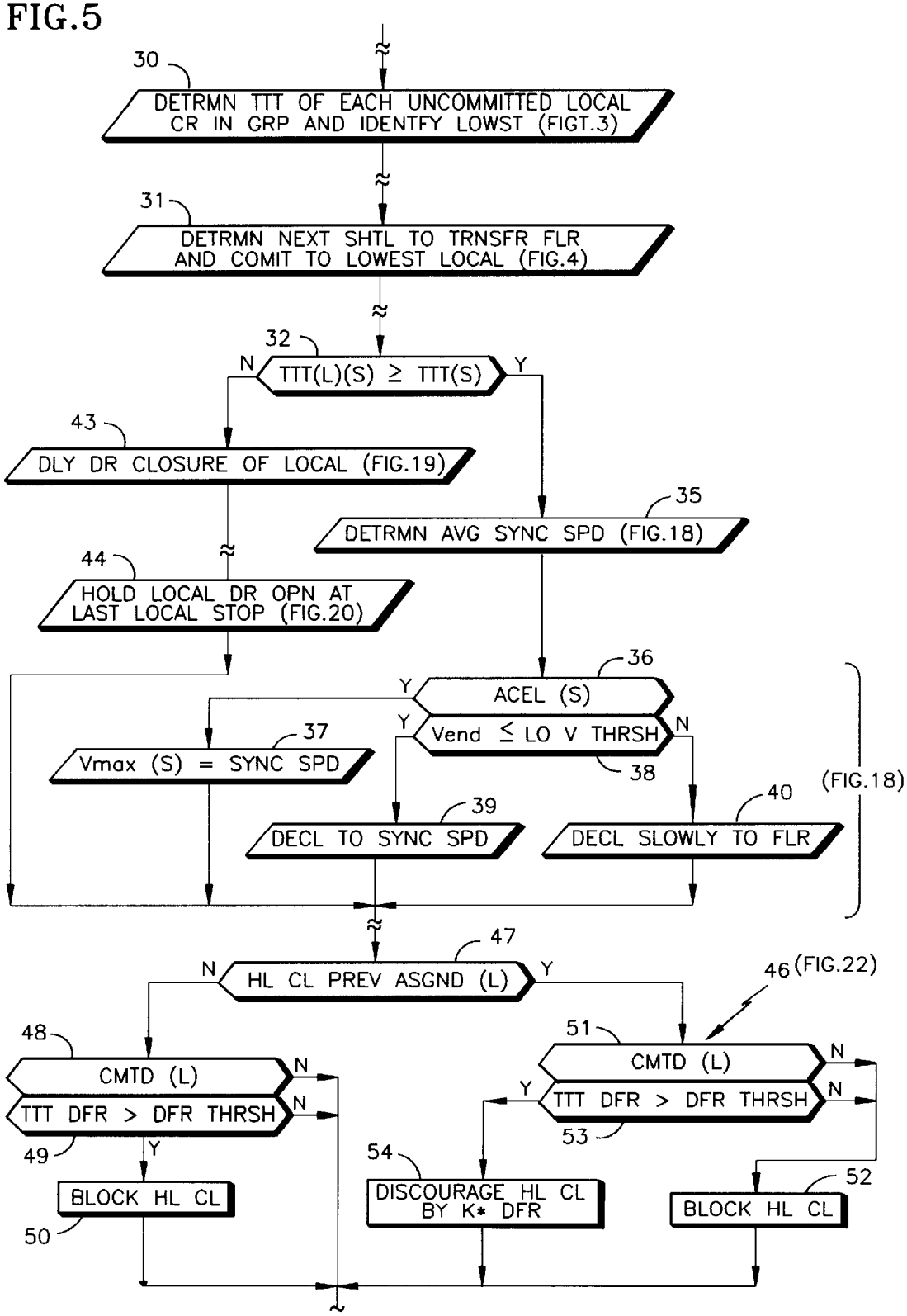
FIG. 5 is a simplified logic flow diagram illustrating routines which may be used in a controller to synchronize the arrival of local elevators with the arrival of shuttle elevators in the system of FIG. 1.

The description which follows assumes the configuration of FIG. 1, but with each of the locals L1–L10 comprising either all low rise elevators or all high rise elevators, such that the passengers traveling upwardly on any shuttle will be served just as well by any one of the local elevators. FIG. 5 is a synopsis of controller program routines for achieving the synchronizing of the shuttles with the locals, as expressed in great detail in a commonly owned, copending U.S. patent application Ser. No. (Attorney Docket No. OT-2291), filed contemporaneously herewith. In FIG. 5, figure numbers within parentheses indicate figures of the aforementioned application Ser. No. (Attorney Docket No. OT-2291) in which the details of such function are shown.

In FIG. 5, a first routine 30 determines the time to transfer floor (TTT) of each uncommitted local car in a group and identifies which one has the lowest time to the transfer floor. This is the calculation frequently referred to as Remaining Response Time (RRT) or the like, which simply considers the number of floors to be traversed, whether they will be traversed one floor at a time at a low speed, or at higher speeds between multiple floors, door opening and closing times, times for boarding and deboarding hall and car passengers, and the like. Then a routine 31 determines the next shuttle in sequence which will travel upwardly to the transfer floor, and causes that shuttle to be matched with the local selected in the routine 30 which had the lowest TTT.

The local elevator, L, which is related to a particular shuttle, S, is referred to as L of S, L(S). Similarly, the TTT for that local is referred to as TTT(L)(S). A test 32 determines if the time the local will take to reach the transfer floor is equal or greater than the time the shuttle will take to reach the transfer floor. This is usually the case, and if so, an affirmative result of test 32 will reach a program 33 to determine the average speed required for the shuttle to utilize in order for its arrival at the transfer floor to be synchronized with the arrival of the local elevator with which it is matched. Then a test 36 determines if the shuttle is still accelerating at this point in the routine, and if it is an affirmative result of test 36 reaches a routine 37 which simply sets the running speed for the shuttle, referred to as Vmax(S), to the speed determined to result in synchronization. But if the shuttle has already reached Vmax, then a test 38 determines if the ending speed, which results if the shuttle is simply decelerated slowly, is less than some threshold speed (in fact, it might even be negative). That is to say, an affirmative result of test 38 indicates that synchronization can only be achieved if the shuttle is immediately slowed down to some very slow speed and utilizes that very slow speed for the remainder of the trip. Such a case reaches a subroutine 39 which causes the shuttle to immediately decelerate to a slow synchronizing speed and to maintain that speed henceforth. But if the car has already accelerated, so test 36 is negative, and yet it can decelerate slowly to achieve synchronization, then a negative result of test 38 will reach a subroutine 40 to cause the shuttle to decelerate slowly, continuously, along the remainder of its trip to the transfer floor. All of the subroutines and tests 35–40 are illustrated in FIG. 18 of the aforementioned application Ser. No. (Attorney Docket No. OT-2291).

In some cases, the selected local will be able to reach the transfer floor before the shuttle, unless it is slowed. In such a case, the test 32 will be negative reaching a subroutine 43 which delays door closure of the local to accommodate the difference in time it will take the local to reach the transfer floor vs. the time it will take the shuttle to reach the transfer floor. This simply counts the remaining stops, divides the difference in TTT by the number of stops, and adds the commensurate delay to the door open time at each of those stops. There is also a subroutine 44 which will hold the door of the local car open at its last local stop, should the local and the shuttle not have been brought into synchronization by delaying door closures in the intermediate stops. This is done on the basis that it is better to have the stopped elevator remain stopped with the doors open, which is not as frightening as being stopped with the doors closed.

When either the shuttle or the local has had measures taken to cause them to arrive at the transfer floor more nearly at the same time, a routine 46 is reached to tend to hasten a shuttle (operative only if the shuttle is indeed tardy in reaching the transfer floor). Within the routine 46, which is a portion of a known hall call assignor routine, a first test 47 determines if the particular hall call being assigned was previously assigned to this particular local elevator. If it was not, then a negative result of test 47 reaches a test 48 to see if this particular local elevator is committed. If it is not committed to any shuttle, then no effect on hall call assignments will occur because a negative result of test 48 causes the remaining penalizing steps to be bypassed. But if this local is a committed local, then a test 49 determines if the amount by which the TTT of the local exceeds that of the shuttle, referred to as the difference, DFR, is greater than a threshold. If it is, this means the local should be hastened somewhat so the assigning of the present hall call to this local is blocked by a step 50. On the other hand, if the present hall call was previously assigned to this local elevator, then an affirmative result of test 47 reaches a test 51 to determine if this local is a committed local. If not, then in accordance with the normal assignor routine, a step 52 will cause the assignment of this hall call to this car a second time to be favored, such as by subtracting some delay factor from the parameter used to make assignments. On the other hand, if the car is committed, then a test 53, similar to the test 49, determines if the local is tardy by some threshold amount. If it is not, then the hall call routine can remain the same and the call will favorably be reassigned to the same local car as a consequence of step 52. But if the tardiness exceeds the threshold, an affirmative result of test 53 will reach a step 54 where the hall call is not blocked, but is discouraged by some amount proportional to the difference, DFR. This variation of a normal hall call assignor routine is illustrated in FIG. 22 of the aforementioned application, Ser. No. (Attorney Docket No. OT-2291).

The synchronizing briefly illustrated with respect to FIG. 5 is not essential to the present invention, but certainly makes the invention more appealing to passengers, and makes the utilization of the elevators when practicing the invention more efficient.

Figure 6:
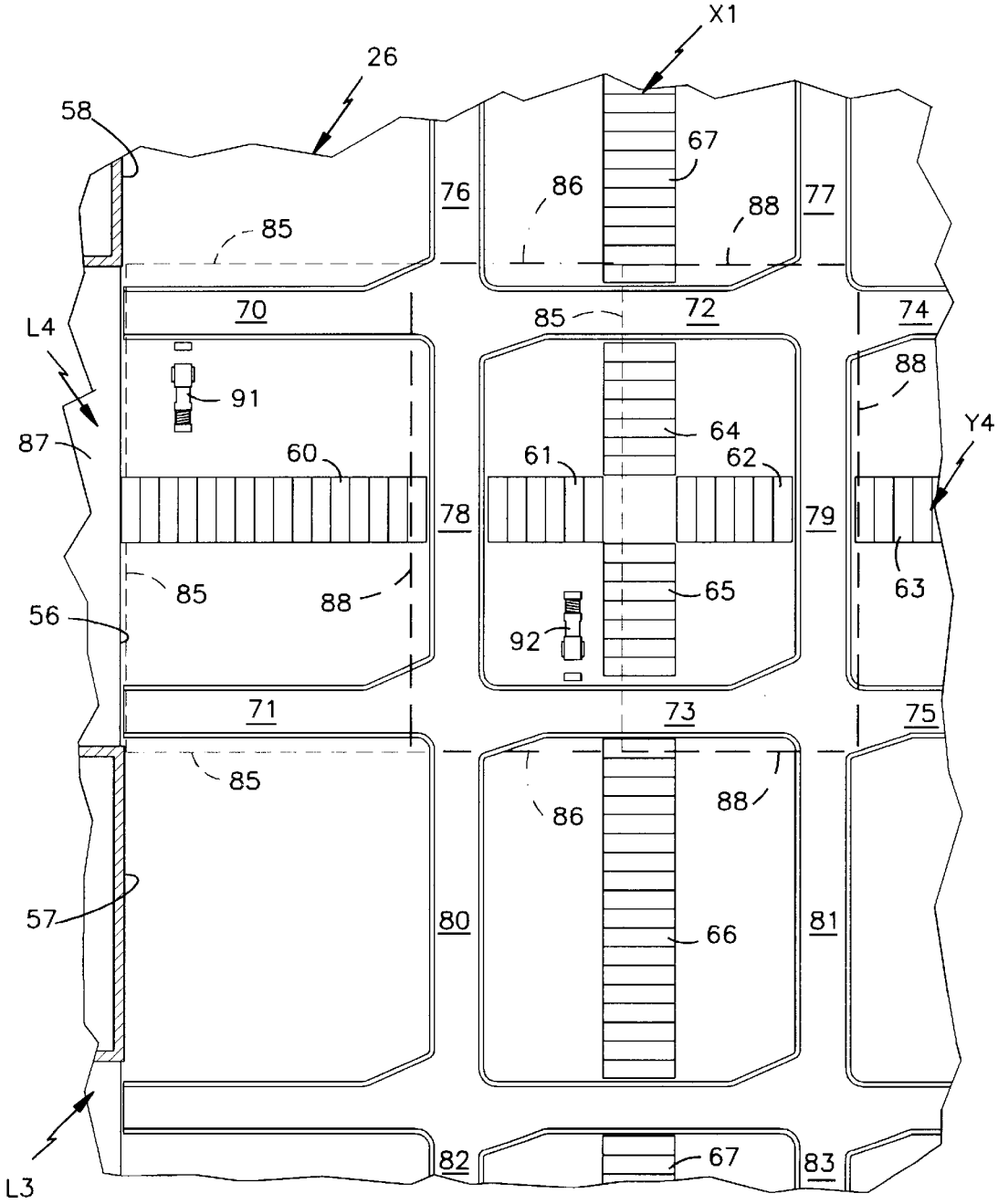
FIG. 6 is a partial, stylized top plan view of the transfer floor of the system of FIG. 1, in accordance with the invention.

Referring now to FIG. 6, a fragment of the transfer floor 26 is shown at the intersection of path X1 with path Y4, adjacent the hatchway 56 of local elevator L4, between walls 57, 58 which separate the hatchways. In the present invention, each of the paths on the transfer floor X1, X2, Y1–Y10 includes segments of linear induction motor (LIM) primaries 60–67 and pairs of wheel track segments such as, along the path Y4, path track segments 70–75 and along the X1 path, track segments 76–83. In FIG. 6, the dotted lines 85 together with the dot dash lines 86 describe the outline of a cab carrier in accordance with the invention when it is positioned adjacent to the local elevator L4, butted up against the sill 87 of the hatchway 56 between inter-elevator wall structures 57, 58. The dash lines 88 together with the dot dash lines 86 describe the outline of the cab when it has moved away from the local elevator L4 to a position centered on the path X1 so that it may travel in the X direction. For clarity, the illustration of FIG. 6 is not drawn to scale. However, it is clear that, if desired, the X path could be closer to the elevators, such as elevator L4, causing the tracks 70, 71 and the segment 60 to be shorter than shown. However, it is believed best to have some length of LIM primary 60 to assure adequate acceleration power for movement of the carriage with a cab on it. The configuration details are irrelevant to the invention and may be selected to suit any implementation thereof.

In this embodiment, carriage/floor locks 91, 92 are disposed in diagonally opposite quadrants within the area where a carriage will come to rest. These may be the same as the cab/car locks disclosed in commonly owned U.S. patent application Ser. No. 08/565,658 filed on Nov. 29, 1995, and described more hereinafter.

Figure 7:
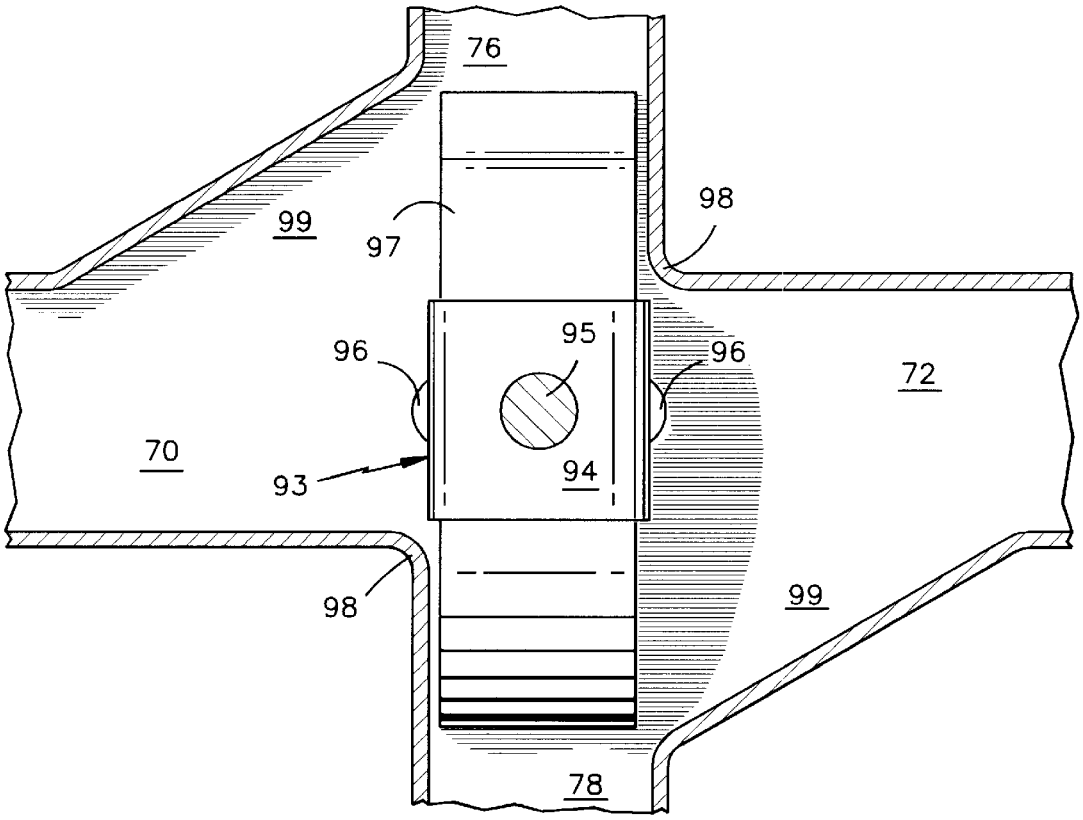
FIG. 7 is a detailed, partial, partially sectioned top plan view of the transfer floor of FIG. 6, illustrating a caster of a cab carrier of the invention at a track intersection.

In FIG. 7, a wheel track intersection between tracks 70, 72, 76 and 78 is shown. A caster 93 includes a bracket 94 that joins a pivot 95 to a spindle 96 which constrains the bearings (not shown) of a wheel 97. The intersection is formed to assure motion: should the carriage first be moved along an X path, so that the caster 93 is in the position shown in FIG. 7, and next be required to move along a Y path, the combination of abutments 98 and open areas 99 in each intersection ensure that the caster can move in the Y direction, either along the track 70 or along the track 72. It should be borne in mind that the distances involved on the transfer floor are extremely small (a few meters overall), and the carriage speed is most likely preferably quite slow so that horizontal movement will not jar the passengers unduly. Under these conditions, passive steering of a caster can be acceptable. However, more complex steering may be provided within the purview of the invention.

Figure 8:
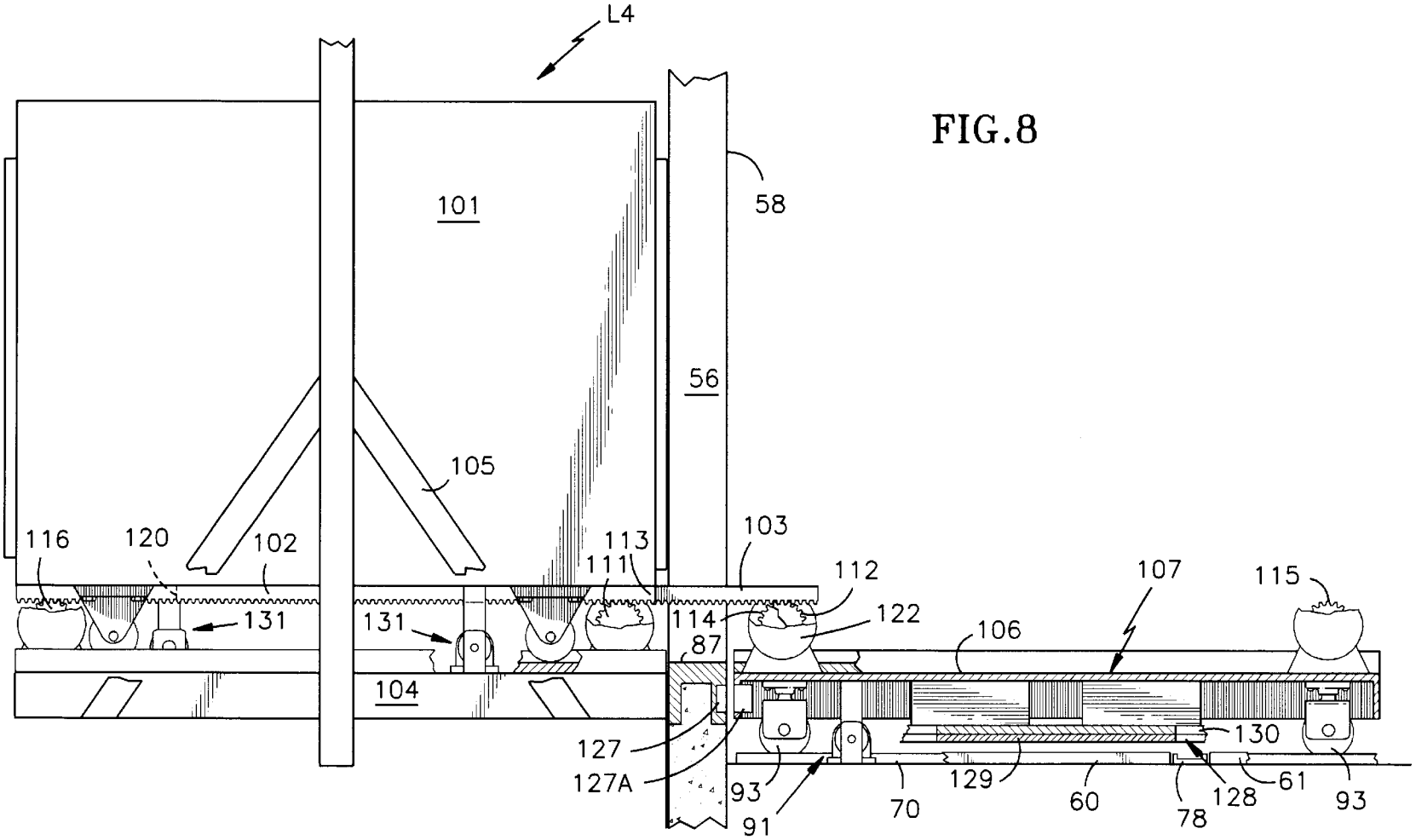
FIG. 8 is a partial, stylized, partially broken away, partially sectioned side elevation view of an elevator cab in the process of being transferred from a car frame within a hoistway onto a carrier in accordance with the invention.
Figure 9:
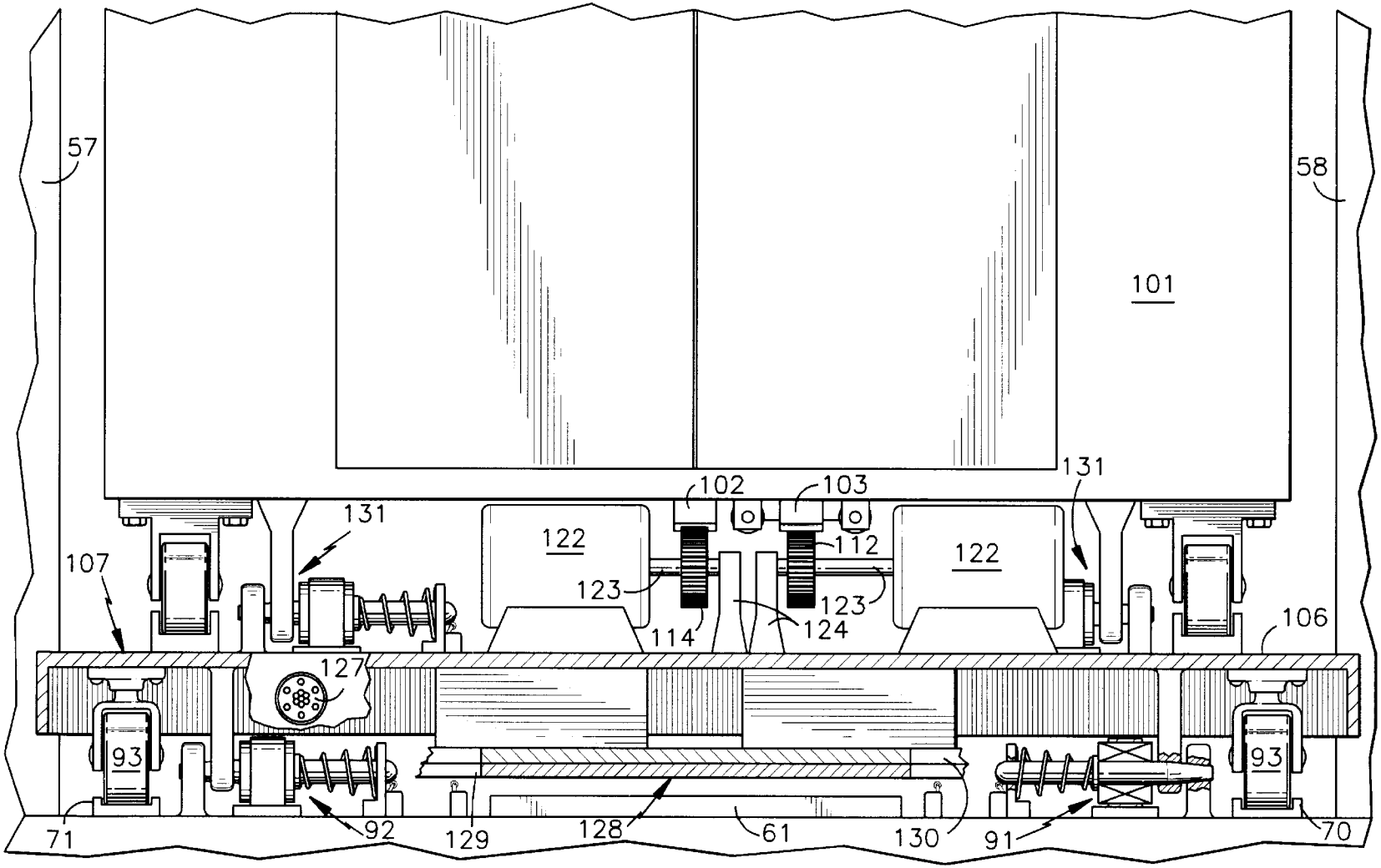
FIG. 9 is a partially sectioned, partially broken away front elevation view of an elevator cab locked onto a carrier in accordance with the invention which in turn is locked onto the transfer floor of FIGS. 1, 3 and 4.

Referring now to FIG. 8 and FIG. 9, the best mode for transferring a cab between elevator cars and carriers at the transfer floor might be that disclosed in commonly owned U.S. patent application Ser. No. 08/564,704, filed on Nov. 29, 1995. In FIG. 8, the bottom of an elevator cab 101 has a fixed, main rack 102 extending from front to back (right to left in FIG. 8), and a sliding rack 103 that can slide outwardly to the right, as shown in FIG. 8. There are a total of four motorized pinions on each platform 104 of the elevator car frame 105 and on each platform 106 of each carrier 107. First, an auxiliary motorized pinion 111 turns clockwise to drive the sliding auxiliary rack 103 out from under the cab into the position shown in FIG. 8 where it can engage an auxiliary motorized pinion 112 on the platform 106 (not shown, behind the pinion 114), which is the limit that the rack 103 can slide. Then, the auxiliary motorized pinion 112 will turn clockwise pulling the auxiliary rack 103 (which now is extended to its limit) and therefore the entire cab 101 to the right as seen in FIG. 8 until such time as an end 113 of the main rack 102 engages a main motorized pinion 114 which is located just in front of the auxiliary motorized pinion 112 in FIG. 8. Then, the main motorized pinion 114 will pull the entire cab 101 fully onto the platform 106 by means of the main rack 102, and as it does so, a spring causes the slidable auxiliary rack 103 to retract under the cab 101. An auxiliary motorized pinion 115 can assist in moving the cab 101 to the right to a shuttle car frame, in the same manner as described for the pinion 111. A pinion behind the pinion 115 can pull a cab onto the carriage 107 from the right. Similarly, an auxiliary pinion 116 can assist in moving a cab from the car frame 104 to the left as shown in FIG. 8, and a pinion located behind pinion 116 can pull a cab onto car frame 104 from the left (although the local elevators in this embodiment will not do so).

To return a cab 101 from the platform 106 to the platform 104, the auxiliary pinion 112 will operate counterclockwise, causing the auxiliary rack 103 to move outwardly to the left until its left end 120 engages the auxiliary pinion 111 on the frame 104. Then, the auxiliary pinion 111 pulls the auxiliary rack 103 and the entire cab 101 to the left until the left end of the main rack 102 engages the main motorized pinion (not shown) located in line with the pinion 111 which then pulls the entire cab to the left until it is fully on the frame 104.

The details respecting the motors 122, shafts 123, pillow blocks 124 and the like are all set forth in the aforementioned application Ser. No. 08/564,704.

As shown in FIGS. 8 and 9, frame 104 of the carriage 107 supports the cab transfer mechanisms which have just been described. Suspended beneath the frame 104 is a LIM secondary 128 which consists of a layer 129 of a conducting metal, such as aluminum, backed by a layer 130 of magnetic material, such as iron. The secondary is in the shape of a cross, such that when the carriage is in the position indicated in FIG. 6 by the dashed lines 88 and the dot dash lines 86, each of the primaries 61, 62, 64, 65 will have a secondary adjacent to it. In this embodiment, the secondary extends to the extremes of the carriage 107 so that the secondary will just about reach the primaries 60, 63, 66 and 68, as well. This ensures that the LIM will be effective even across the dead spaces formed by the various wheel tracks. The X-Y LIM of the present invention can, through successive energization of the correct segments 60–67, and similar segments, with a suitable frequency to determine speed and current to determine force, cause acceleration, velocity and deceleration in a known fashion as required to move the carriage around the paths of the transfer floor 26. Thus, the transportation of the cab on the carriage occurs with the carriage being totally passive. However, to transfer a cab from an elevator car frame onto the carriage, or from the carriage onto an elevator car frame, the motors 122 must be energized appropriately. Therefore, electrical connections must be made between a carriage and a sill such as between a socket plug assembly 127 on the carriage and a related socket plug assembly 127*a* mounted in each of the sills (FIG. 8). In fact, each carriage will have two socket/plug assemblies 127, one on an edge as shown in FIG. 8, for interconnection at the local sills and one on an edge as shown in FIG. 9 for interconnection with the shuttle sills.

In transporting the carriage between a shuttle and a local elevator, the carriage motion controller, which controls the LIM, may respond to a network of proximity sensors (not shown) on the transfer floor, or the carriages may be provided with rotary position transducers operable distinctively in the X and Y directions, and transfer the bit information thereof to the controller in the building, either by a radio type transmitter or through the wheel tracks or other conductors on the floor by means of brushes. Or, the position may be tracked by inductive response in the LIM, or in any other suitable fashion. All of this is irrelevant to the present invention and may be selected to suit any given implementation thereof.

In FIG. 9, a pair of cab/carriage locks 131, which may be the same as the locks 91, 92 are utilized to ensure the cab is rigidly secure to the carriage during motion of the carriage with the cab on it. The locks, as described in the aforementioned application Ser. No. 08,565,658 are maintained in the locked position by a spring, and electrical current in a solenoid causes them to be unlocked. The current for unlocking these locks will also be applied, selectively, through the connectors 127, 128.

Figure 10:
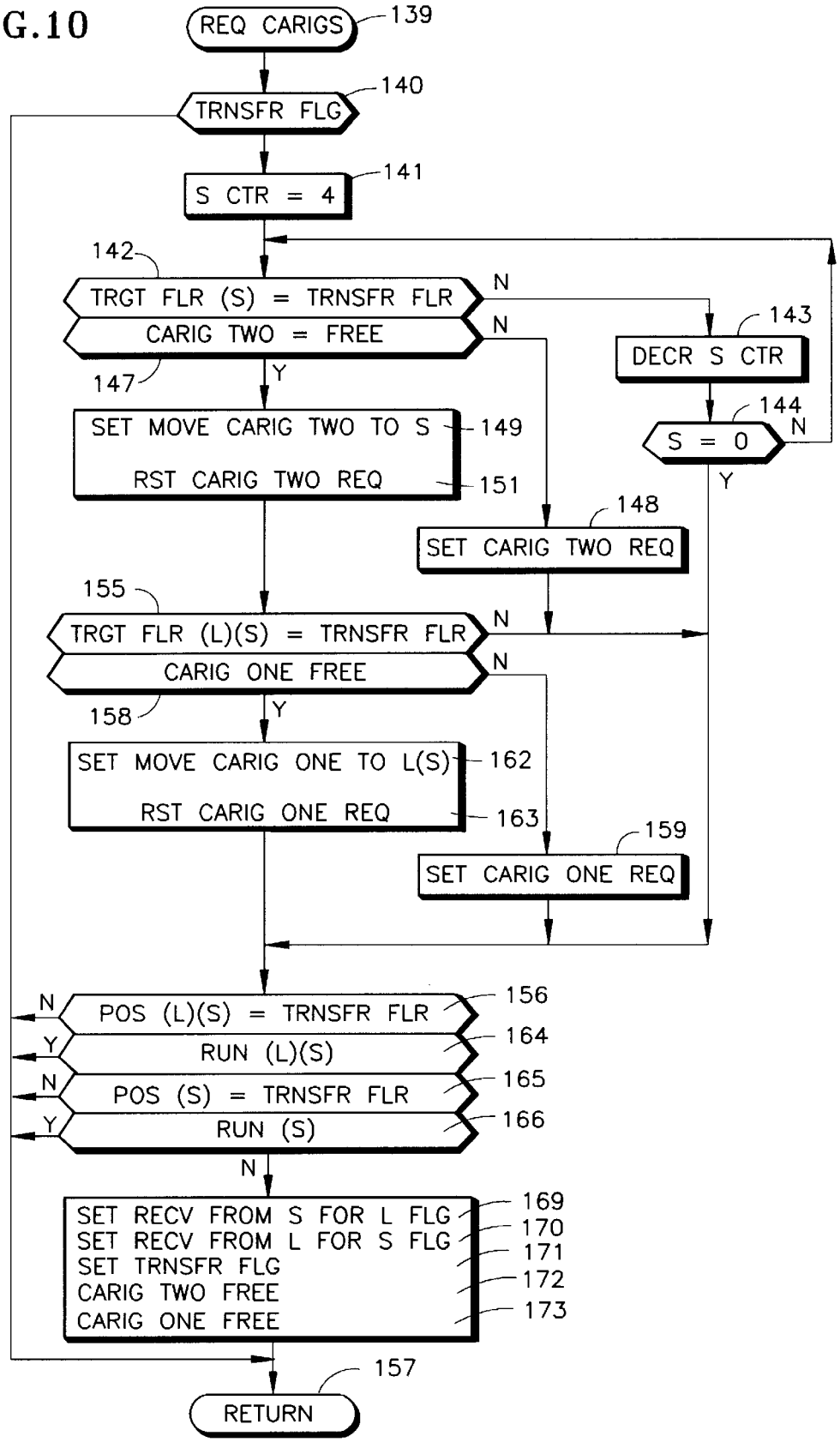
FIG. 10 is a logic flow diagram of a Request Carriages Routine.

The methodology of the present invention includes the fact that prior to reaching the floors, carriages are called to the elevators where they will be needed, as described in FIG. 10. As described more fully hereinafter, when the shuttles are not in use, each will simply remain locked in place at the hatchway of the elevator where it has last delivered a cab to an elevator. Referring now to FIG. 10, a Request Carriages routine is reached several times per second through a transfer point 139 and a first test 140 determines if a transfer flag has been set, or not. This is a flag, described more fully hereinafter, which keeps track of the fact that cabs are presently being moved across the transfer floor, and that therefore other control over the cabs is not only unnecessary, but not possible. Assume now that both carriages are sitting idly awaiting a new assignment. In such a case, test 140 will be negative reaching a step 141 to set an S counter to the number of shuttles in the group, in this example, four. Then a test 142 determines if the target floor for the shuttle being considered is the transfer floor. If it is not, it will play no part in the role of a carriage so a negative result of test 142 reaches a step 143 to decrement the S counter. Then a test 144 determines if all of the shuttles have been considered or not. Initially they will not have, so a negative result of test 144 reverts the program to test 142 to consider the target floor of the next shuttle in turn. Assuming that the shuttle presently under consideration is moving toward the transfer floor, an affirmative result of test 142 reaches a test 147 to determine if carriage two is free, or not. Carriage two is whichever carriage is stored along or near the X2 path, on the shuttle side of the transfer floor. As described hereinafter, a carriage being free also includes the fact that it is unlocked and able to be moved. In this embodiment, the carriages remain locked at the point where they last delivered their cabs, until they are needed for the next run. Therefore, the first pass through test 147 will always be negative, reaching a step 148 which will set a carriage two request. This will indicate that the carriage is needed, perhaps elsewhere, and cause its floor locks to become unlocked, as described with respect to FIG. 11, hereinafter. In a next subsequent pass through the routine of FIG. 10, test 140 will be negative, step 141 will start with S equal to four, but this will be decremented until the same shuttle that is being considered is reached again. In this case, test 142 will again be positive but now test 147 is also positive. This reaches a step 149 to set a command to move carriage two to shuttle S. A step 151 resets the carriage two request which had been set in step 148.

Then the same functions are performed for whichever local, L(S), has been matched up with the shuttle in question, with respect to carriage one, which is the carriage parked at one of the locals. A test 155 determines if the particular local is headed for the transfer floor or not. If not, nothing will transpire at this time and a negative result of test 155 reaches a test 156 to determine if the shuttle is at the transfer floor or not. In a normal case, the local may be moving upwardly and still be the local which will arrive at the transfer floor the quickest, so during the first few passes through the routine of FIG. 10, test 155 may be negative. And of course test 156 will be negative, so no other functions are performed and other programming may be reverted to through the return point 157. Eventually, the selected local will be headed toward the transfer floor so an affirmative result of test 155 reaches a test 158 to determine if carriage one is free. Initially it will not be so a step 159 will set the carriage one request, which, in FIG. 11, will ensure that the carriage floor locks are unlocked and then set the indication that carriage one is free. In subsequent passes through the routine of FIG. 10, when the steps and tests 141–144 reach the shuttle which has been under consideration, tests 142 and 147 will be positive redundantly performing steps 149 and 151 and once again reaching test 155, which will be affirmative. In this pass through FIG. 10, test 158 is affirmative so a step 162 sets a command to move carriage one to the local which is related to this shuttle, L(S), and a step 163 resets the carriage one request which had been set in step 159.

Because of test 156, no other functions are performed in FIG. 10 until the local assigned to a shuttle under questions reaches the transfer floor. In all the passes through FIG. 10 before that time, test 142, 147, 155 and 158 are all affirmative, redundantly but harmlessly performing steps 149, 151, 162 and 163. Eventually, in some subsequent pass through FIG. 10, test 156 is affirmative reaching a test 157 to see if the local has stopped running. Until it is completely at rest, an affirmative result of test 157 will cause other programming to be reached through the return point 157. Similarly, test 165 and 166 will determine when the shuttle is at the transfer floor and is no longer in a run condition. Next a pair of steps set flags indicating which way the cabs are going. For instance, when a carriage has a cab on it, and it is standing at the sill of the local or a shuttle, that cab may have just been put on the carriage by the adjacent local or shuttle, or that cab may have traveled across the transfer floor from the other elevator. The steps 169 and 170 set flags indicating that transfer off of the elevator car frames onto the carriages are to occur. Then a step 171 sets the transfer flag so that the routine of FIG. 10 will no longer be performed until the cabs have all been moved. And steps 172 and 173 reset carriage two free and carriage one free in preparation for the next utilization of the routine of FIG. 10.

Figure 11:
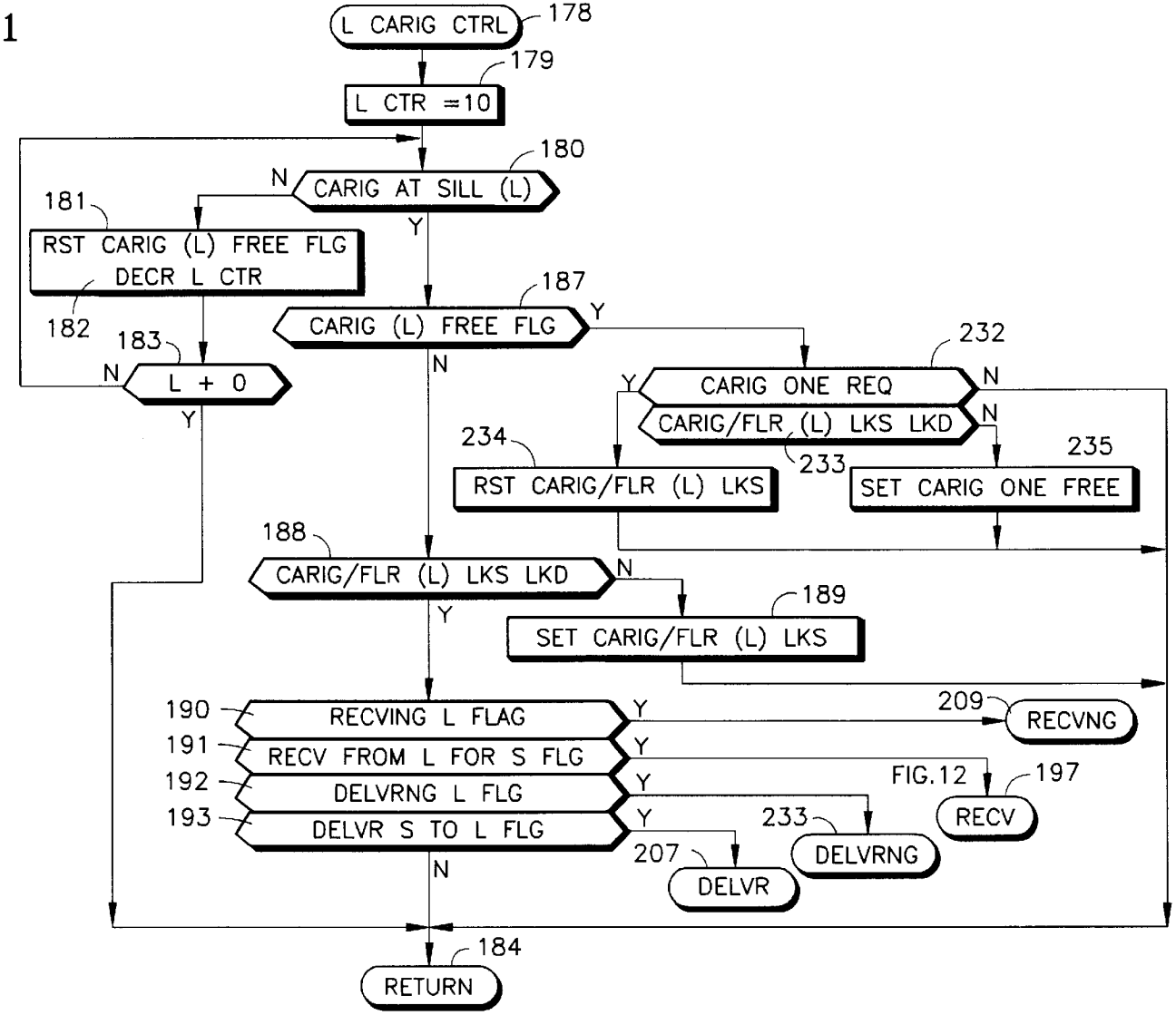
FIGS. 11–13 are a logic flow diagram of a Local Carriage Control routine, FIG. 12 being a diagram of a Receiving subroutine and FIG. 13 being a diagram of a Delivery subroutine.

The next function that occurs assumes that each carriage has been moved to a corresponding elevator in response to a request, initiated by the flags set in steps 169 and 170, and its presence at a sill is known by proximity sensors, or by connection through the connectors 127, 128, or both. As described in the aforementioned applications Ser. Nos. 08/565,658 and 08/565,648, the car/floor locks and cab/car or cab/carriage locks will preferably have switches on them so as to determine when the locks are affirmatively locked as well as to determine when the locks are affirmatively unlocked. The next phase of the method is that the carriage will be locked in place and an elevator cab will be moved from the elevator car frame onto the carriage for transfer across the transfer floor to the other elevator. Using the local as an example, the Local Carriage Control routine is illustrated in FIG. 11 and reached through an entry point 178. In this instance, the local is considered as having an identity unto itself, rather than being a local assigned to a shuttle. A first step 179 sets an L counter to the number of shuttles in the group, which in this instance is ten. Then a test 180 determines if there is a cab at the sill of this local. For most of the locals, test 180 will be negative reaching a step 181 which is redundantly performed for most locals. This step operates as soon as a free carriage, commandeered for another trip, leaves the sill where it was resting to go to another local in response to step 162, FIG. 10. A step 182 then decrements the L counter and a test 183 determines if all the locals have been tested or not. Bear in mind that much of the time there will not be a carriage at the sill of any local, such as when the carriages are moving from one elevator to the other. In that case, an affirmative result of test 183 will reach a return point 184 so the controller can revert to other programming. However, after one of the locals has had detail functions of the routine of FIG. 11 performed, the other locals are not tested because the functions reach the return point 184 (or a similar point in FIGS. 12 or 13).

Assume now that the L counter is pointing to a local which is about to receive an elevator cab. Test 180 is affirmative reaching a test 187 to see if the carriage standing at this sill is deemed to be free or not. This condition will occur only after cabs have been transferred in both directions and the cab transfer is complete. Therefore, in all of the earliest passes through the routine of FIG. 11, test 187 is negative, reaching a test 188 to see if the carriage/floor locks for the floor at local L are locked or not. These are the locks 91 and 92 shown in FIGS. 6 and 9. If the cab has just arrived at local L, which is the usual case, its locks will not be set so a negative result of test 188 reaches a step 189 to set the carriage/floor locks for local L. And then other programming is reached through the return point 184. It may take more than a few microseconds to get the locks locked, but eventually, in a subsequent pass through the routine of FIG. 11, test 188 will be affirmative reaching a series of tests 190–193 to determine which task to perform and to help progress through that task. Test 190 will initially be negative reaching a test 191 to determine if a cab is to be received from the local elevator for delivery to the shuttle elevator, which is the assumption being made here. Once it gets part way through that task, test 190 will become affirmative to aid in controlling of the routine. An affirmative result of test 191 will be reached in this case because the receive from L for S flag was set in step 170 within the routine of FIG. 10. Therefore, the Receive routine of FIG. 12 will be reached through a transfer point 197.

Figure 12:
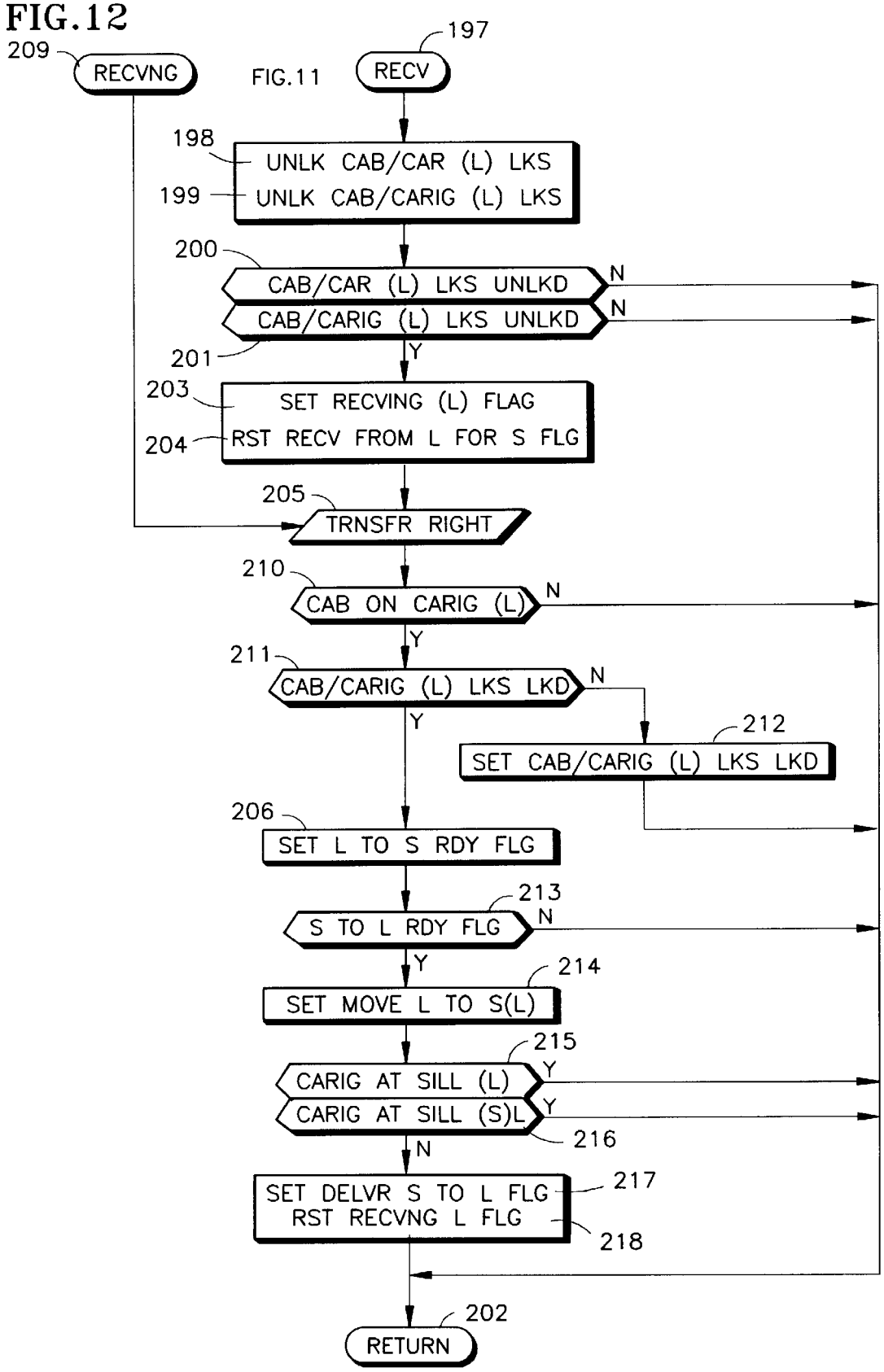

In FIG. 12, a first pair of steps 198, 199 cause the cab car locks in the local elevator L to become unlocked and cause the cab carriage locks on the carriage standing at the sill of local elevator L to become unlocked. The cab carriage locks are the locks 131 of FIG. 9. Then a pair of tests 200, 201 determine when the locks are unlocked. Until the locks become unlocked, negative results of either one of these tests will cause other programming to be reached through a return point 202. Eventually, the locks will be unlocked so an affirmative result of tests 200 and 201 will reach a step 203 to set a receiving flag for local elevator L, and to reset the receiving from L for S flag which initiated this process. And then a Transfer Right routine 205 is reached.

This is a routine that performs the details of causing the cab to be moved off the elevator platform and onto the carriage, in a fashion described very briefly with respect to FIGS. 8 and 9 hereinbefore, and described more fully in the aforementioned application Ser. No. 08/564,704. During the performance of this routine, while mechanical parts are moving from one point to another and the like, there are many times when the routine reverts, as through the return point 202, to other programming. As shown here, the Transfer Right routine will be reentered each time that FIG. 11 is performed since, for the local car having a carriage at its sill, test 180 is affirmative, test 187 is negative, test 188 is affirmative, and test 190 is now affirmative since the receiving L flag was set in step 203 of FIG. 12. This causes the program to transfer through the transfer point 209 to reenter the Transfer Right routine 205. Eventually, when the cab has been fully moved from the local elevator to the right (as seen in FIG. 2) and onto the carriage, a test 210, which may be within the Transfer Right routine 205, determines when the cab is fully on the carriage of this local elevator. When it is fully on the carriage, as determined by switches described in the aforementioned applications, a test 211 determines if the cab/carriage locks for the carriage at the sill of local elevator L are locked, or not. Initially they will not be so a negative result of test 211 reaches a step 212 to set the cab carriage locks for the carriage at the sill of local elevator L. When the locks are set, an affirmative result of test 211 will reach a step 212 to set an L to S ready flag, indicating that a trip from L to S may begin at an appropriate time. Then a test 213 determines if a commensurate S to L ready flag has been set by the shuttle, or not. This mutual interlocking is utilized to cause the cabs to leave their respective elevators at the same time, thereby to ensure they will pass each other without collision, one on the X path and one on the Y path. When both carriages have a cab locked thereon, test 213 will be affirmative reaching a step 214 to set a command to move the carriage from the local elevator L to the shuttle elevator which has been matched up with this local, S(L). Then a pair of tests 215, 216 determine if the carriages at the related local and shuttle have left, or not. As long as either carriage is still at a sill, an affirmative result of either test 215 or test 216 causes other programming to be reached through the return point 202. But once the carriages have embarked on their trips, so that their carriage controls can no longer have any effect on them, then a negative result of tests 215 and 216 will reach a step 217 to set a deliver S to L flag which is a command, distinctive from the receive from L for S flag, which was set in step 170 in FIG. 10. The flag set in step 217 will cause a cab transferred across the transfer floor from a shuttle to be loaded onto a local elevator, in a manner described hereinafter. Once this flag is set, the receiving L flag utilized in step 190 of FIG. 11 to reach the Transfer Right routine of FIG. 12, is reset. In any passes through the routine of FIG. 11 until both carriages leave their respective sills, test 190 will be affirmative causing the routine of FIG. 12 to advance through an already completed Transfer Right routine and the various tests of FIG. 12 to tests 215 and 216. But once the cabs have left the sills, then the mode of control is changed by setting the deliver L to S flag and resetting the receiving L flag in steps 217, 218.

In a subsequent pass through FIG. 11, a carriage is no longer at sill L so that when the L counter is set at the number of a local elevator that is exchanging cabs it will nonetheless have a negative result. In this case, all of the locals will have a negative result so test 183 is affirmative causing the routine of FIG. 11 to be bypassed through the return point 184.

Eventually, the other carriage, one bearing a cab which has just been removed from the shuttle, will appear at the sill of the local elevator. In a subsequent pass through the routine of FIG. 11 when a carriage has appeared at the sill with a cab on it, test 180 will be affirmative reaching test 187 which is negative and test 188 which is initially negative causing step 189 to set the carriage floor locks at the sill of local elevator L. Then other programming is reached through the return point 184. In a subsequent pass, test 188 is affirmative for this local elevator so as to reach the tests 190, 192 and 193, all of which are negative. But since step 217 of FIG. 12 had set the deliver S to L flag, test 193 is affirmative reaching the deliver routine of FIG. 13 through a transfer point 207.

Figure 13:
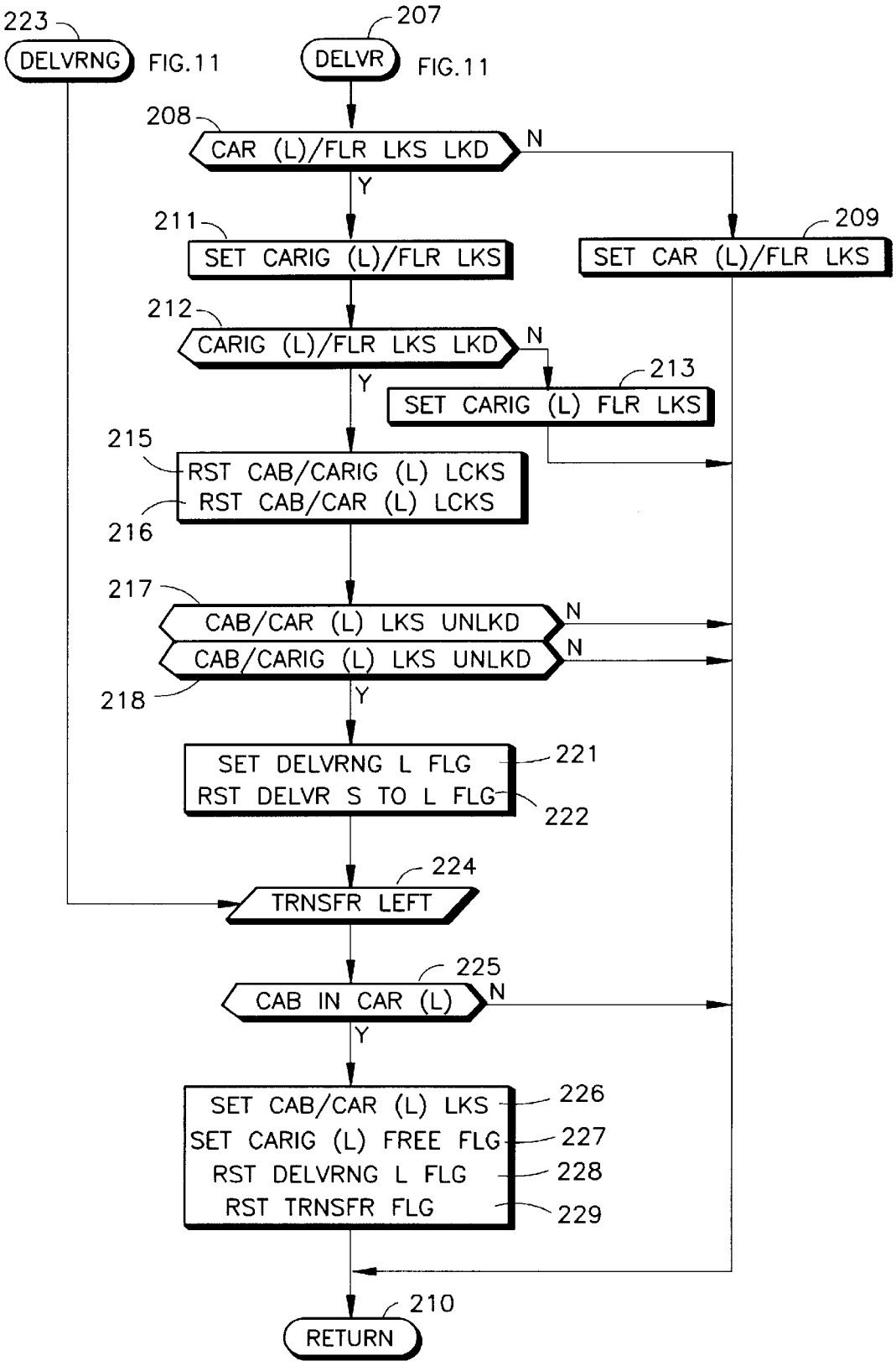

In FIG. 13, a first test 208 determines if the car/floor locks which lock the car frame to the wall of the hoistway for local elevator L, are locked, or not. Normally they will be locked but if not, a step 209 commands that such should become locked and then other programming is reached through a return point 210. In the usual case, the car/floor locks are locked so an affirmative result of test 208 reaches a test 211 to set the carriage/floor locks for the carriage at the sill of local elevator L. This is necessary since the carriage has only momentarily arrived on its trip across the transfer floor and its locks will not have yet been set. Then a test 212 determines if the carriage L floor locks are locked. If not, a step 213 sets them. Until they are locked, other programming is reached through the return point 210. When the carriage is locked, an affirmative result of test 212 reaches a pair of steps 215, 216 to cause the cab/carriage locks of the carriage at local elevator L and the cab/car locks on local elevator L to be reset so that the cab may be moved onto the elevator car frame. A pair of tests 217, 218 bypass the rest of the program through the return point 210 until both sets of locks are unlocked. Then, a step 221 sets the delivering L flag and a step 222 resets the deliver S to L flag, so that the steps and tests just described will be bypassed in further passes through the routine of FIG. 11 and FIG. 13. In the next pass through the routine of FIG. 11, when the local elevator in question is reached, test 180 will be affirmative, test 187 is negative, test 188 is affirmative, test 190 and 191 are negative reaching test 192, which is now affirmative. This causes the program to advance through a transfer point 223 to a Transfer Left routine 224 in FIG. 13. This causes the cab to be physically moved onto the elevator car as described briefly with respect to FIGS. 8 and 9 hereinbefore. During the transfer routine, other programming is reached, as indicated through the return point 210 many times, as mechanical motion and other events occur. In each pass through the routine of FIG. 11, when the local elevator delivering the cab is reached by the steps and tests 179–183, test 180 is affirmative, test 187 is negative, test 188 is affirmative, test 190 and 191 are negative, and test 192 is affirmative again passing through the transfer point 223 to the routine 224 in FIG. 13. Eventually, the cab will be moved fully into the car frame of local elevator L so an affirmative result of a test 225 will reach a plurality of steps 226–229 to set the cab/car locks in the local elevator L, to set the carriage free flag for the carriage at local elevator L and to reset the delivering L flag and the transfer flag. Between now and the time that another local is picked as a next local and is traveling toward the transfer floor, the carriage will simply remain locked to the floor at the sill of local elevator L.

Resetting the transfer flag enables the next mode of operation, the movement of an available carriage to another local where a next cab will be delivered, as is described hereinbefore with respect to FIG. 10. Referring again to FIG. 10, when this carriage is then commanded to be used for another pair of cabs, the test 158 determines if carriage one (the carriage adjacent to the locals) is free or not. Initially, test 158 is always negative reaching the step 159 to set the carriage one request. In FIG. 11, each time the program reaches a local for which test 180 is affirmative, it will reach test 187. During the resting phase, test 187 is always affirmative for the elevator which has a carriage resting at its sill. This causes a test 232 to determine if a request for this carriage has been made or not. In most of the passes through FIG. 11, test 232 will be negative. But as soon as a local is approaching the transfer floor, the carriage one request will be made in FIG. 10, and test 232 will be affirmative. This will reach a test 233 to determine if the carriage/floor locks at the floor of local L are locked, or not. Initially, they will be, so an affirmative result of test 233 reaches a step 234 to reset the carriage/floor locks at local L. Then other programming is reached through the return point 184. It may take a second or two to reset the floor locks so there may be several passes through FIG. 11 in which a negative result of test 233 will cause other programming to be reached. Eventually, the locks will be unlocked, so a negative result of test 233 will reach a step 235 to set carriage one free, for use in FIG. 10. In FIG. 10, in turn, this will cause the command to move carriage one to another local elevator in step 162. As soon as the elevator leaves the sill, the carriage L free flag will be reset; it cannot be reset before the carriage leaves the sill since a negative result of test 187 would cause the floor locks to again be locked. This would be a program glitch. In any embodiment of the invention in which the carriage might be used at the same local elevator twice in a row, then the test 235 should be followed by a test to see if L equals L of S; if it does, then a step can be performed right after step 235 to reset the carriage L free flag, since the carriage will never leave the sill. Thus, the phases of methodology include waiting for a next car to approach, unlocking and moving to the sill of that next car, locking and receiving a cab, moving to a shuttle, becoming locked and transferring that cab to the shuttle. Then waiting at the shuttle until it is needed for another transfer.

A similar operation occurs in the opposite direction. That is to say, there is an S carriage control routine (not shown) similar in all respects to FIGS. 11–13, but relating to the shuttle and any carriage in the vicinity of the shuttles.

In the foregoing description, the shuttle elevators S1–S4 are on opposite sides of the pathway on the transfer floor from the local elevators, in each embodiment. However, the invention may be used to interconnect but a single elevator with a selected elevator of a group, and the invention may be used to transfer elevator cabs between groups which themselves are not opposite, but rather bear some other relationship, such as on two separate sides of a square, or along the same side of a rectangle with each other. In the description, many of the paths Y4–Y7 extend directly between a local elevator and a shuttle. However, the invention can be practiced with paths that are not continuous between opposing elevators, if desired. The present invention shows two, interconnecting X paths, but the invention may be practiced where passing is not required with only a single interconnecting path. In fact, the interconnecting paths need not even be straight, one or two of them might even comprise circles or some other configuration in any embodiment where such is advisable. Although not disclosed herein, the ability for cabs that are passing from one elevator to an elevator directly opposite the transfer floor may be moved to a different Y path to permit passing, as is described in detail in the aforementioned application Ser. No. (Attorney Docket No. OT-2291).

The present invention has been described with a passive carrier, which is disclosed as a carriage with wheels. The carrier need not be a carriage with wheels, but may be any sort of levitation device, while still taking advantage of the present invention. Furthermore, the carrier need not be passive, and in any case where power will be available to the carrier as it moves from one elevator to another, it would be preferred to have the LIM primary disposed on the carrier whereby the vast majority of the LIM segments, those in the paths on the transfer floor, may be relatively inexpensive secondaries. The invention is disclosed as having a carrier which is propelled by means of a LIM, the portion of which is on the transfer floor. However, self-propelled carriers are known and the present invention may be practiced with self-propelled carriers, if desired. In the event that LIM primaries are mounted on the carrier and LIM secondaries on the transfer floor, the segments 60–67 would simply be sheets of a conductor such as aluminum on top of sheets of magnetic material, such as iron. The wheels of the carrier could, of course, be other than casters.

All of the aforementioned patent applications are incorporated herein by reference.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. An elevator system, comprising:

a first elevator hoistway;

a group of second elevator hoistways;

a carrier adapted to receive an elevator cab from an elevator car frame in a hoistway, and adapted to deliver a cab to an elevator car frame in a hoistway; and a horizontal pathway extending from each one of said first and second hoistways to a plurality of other ones of said first and second hoistways, said pathway comprising means for guiding said carriage along said pathway.

2. Apparatus according to claim 1 wherein:

said carrier comprises a carriage with wheels; and said pathway comprises tracks for guiding said wheels.

3. Apparatus according to claim 1 wherein:

said pathway comprises segments of a first portion of a linear induction motor (LIM); and said carrier comprises a second portion of said LIM disposed thereon in proximity with said first portion.

4. Apparatus according to claim 3 wherein said pathway comprises LIM primary windings.

5. Apparatus according to claim 3 wherein: said carrier comprises a carriage with wheels.

6. An elevator system, comprising:

a first elevator hoistway;

a group of second elevator hoistways;

a carrier adapted to receive an elevator cab from an elevator car frame in a hoistway, and adapted to deliver a cab to an elevator car frame in a hoistway; and a plurality of intersecting horizontal paths, including a plurality of first paths, one for each of said first and second hoistways, each extending outwardly from a corresponding one of said hoistways, and a second path interconnecting each of said first paths, each path comprising means for propelling said carriage along said paths.

7. Apparatus according to claim 6 wherein said paths comprise a first portion of a LIM; and said carrier includes a second portion of said LIM disposed thereon in proximity with said first portion.

8. Apparatus according to claim 7 wherein said paths comprise LIM primary windings.

9. Apparatus according to claim 6 wherein said carrier comprises a carriage with wheels.

10. An elevator system, comprising:

a first elevator hoistway;

a group of second elevator hoistways;

a plurality of intersecting horizontal paths, including a plurality of first paths, one for each of said first and second hoistways, each extending outwardly from a corresponding one of said hoistways, and a second path interconnecting each of said first paths;

a carrier moveable along all of said paths and adapted to receive an elevator cab from an elevator car frame in a hoistway, and adapted to deliver a cab to an elevator car frame in a hoistway; and means for moving said carrier along all of said paths.

11. Apparatus according to claim 10 wherein said means for moving comprises:

a LIM having a primary portion and a secondary portion, one of said portions extending along said paths and the other of said portions being disposed on said carrier in proximity with said one portion.

12. Apparatus according to claim 11 wherein said LIM comprises a plurality of primary windings distributed along said paths.

13. Apparatus according to claim 10 wherein said carrier comprises a carriage with wheels.

14. An elevator system, comprising:

a first elevator hoistway;

a group of second elevator hoistways;

a plurality of carriers, each adapted to receive an elevator cab from an elevator car frame in a hoistway, and adapted to deliver a cab to an elevator car frame in a hoistway; and a plurality of intersecting paths, including a plurality of first paths, one for each of said first and second hoistways, each extending outwardly from a corresponding one of said hoistways, and a plurality of second paths intersecting each of said first paths, said second paths being mutually separated sufficiently to permit one of said carriers on one of said second paths to pass the other of said carriers on the other of said second paths, said paths each comprising means for guiding said carriers therealong.

15. Apparatus according to claim 14 wherein:

said carrier comprises a carriage with wheels; and said paths comprise tracks for guiding said wheels.

16. Apparatus according to claim 14 wherein:

said paths comprise segments of a first portion of a LIM; and said carriers each comprise a second portion of said LIM disposed thereon in proximity with said first portion.

17. Apparatus according to claim 16 wherein said paths comprise LIM primary windings.

18. Apparatus according to claim 14 wherein said carrier comprises a carriage with wheels.

19. An elevator system, comprising:

a first elevator hoistway;

a group of second elevator hoistway;

a plurality of carriers, each adapted to receive an elevator cab from an elevator car frame in a hoistway, and adapted to deliver a cab to an elevator car frame in a hoistway; and a plurality of intersecting paths, including a plurality of first paths, one for each of said first and second hoistways, each extending outwardly from a corresponding one of said hoistways, and a plurality of second paths intersecting each of said first paths, said second paths being mutually separated sufficiently to permit one of said carriers on one of said second paths to pass the other of said carriers on the other of said second paths, said paths each comprising means for propelling said carriers therealong.

20. Apparatus according to claim 19 wherein said paths each comprise a first portion of a LIM; and said carriers each include a second portion of said LIM disposed thereon in proximity with said first portion.

21. Apparatus according to claim 20 wherein said paths comprise LIM primary windings.

22. Apparatus according to claim 14 wherein said carrier comprises a carriage with wheels.

23. An elevator system, comprising:

a first elevator hoistway;

a group of second elevator hoistways;

a plurality of intersecting paths, including a plurality of first, mutually parallel paths, one for each of said first and second hoistways, each extending outwardly from a corresponding one of said hoistways, and a second path extending perpendicularly to said first paths and intersecting each of said first paths;

a carrier moveable along said paths and adapted to receive an elevator cab from an elevator car frame in a hoistway, and adapted to deliver a cab to an elevator car frame in a hoistway; and a LIM for moving said carrier along said paths, said LIM having a primary portion and a secondary portion, one of said portions extending along said paths and the other of said portions being disposed in the shape of an orthogonal cross on said carrier in proximity with said one portion.

24. Apparatus according to claim 23 wherein said paths comprise a LIM primary and said carrier has a LIM secondary.

25. Apparatus according to claim 23 wherein said carrier is a carriage with wheels.

26. Apparatus according to claim 23 further comprising:

a second carrier having a same LIM portion as said first-named carrier;

a third path parallel with said second path and separated therefrom sufficiently so that said carriers can pass each other when one of said carriers is on said second path and one of said carriers is on said third path, said one LIM portion also extending along said third path.

27. A method of moving an elevator cab between a car frame in one hoistway of a building to a car frame in another hoistway which is not contiguous with said one hoistway, comprising:

offloading an elevator cab from an elevator car frame in a first hoistway onto a carrier;

moving said first cab to a second hoistway on said carrier along a pathway on a floor level of said building which includes a plurality of distinct paths, each of which connect said first hoistway with a selected one of a plurality of hoistways, including said second hoistway; and loading said cab from said carrier onto a second elevator car frame in said second hoistway.

28. A method according to claim 27 further comprising:

before said moving step, offloading a second elevator cab from said second elevator car frame in said second hoistway onto a second carrier;

moving said second cab on said second carrier, along a pathway which is partially coextensive with said first pathway but includes a path separated therefrom, to said first hoistway simultaneously with moving said first-named cab to said second hoistway, said cabs passing each other; and loading said second cab from said second carrier onto said first-named elevator car frame in said first elevator hoistway.

29. Apparatus for offloading an elevator cab from an elevator car frame in a first hoistway of a building onto a carrier, moving said first cab to a second hoistway, which is not contiguous with said first hoistway, on said carrier along a pathway on a floor level of said building which includes a plurality of distinct paths, each of which connect said first hoistway with a selected one of a plurality of hoistways, including said second hoistway, and loading said cab from said carrier onto a second elevator car frame in said second hoistway, comprising:

a plurality of carriers, each adapted to receive an elevator cab from an elevator car frame in a hoistway, and adapted to deliver a cab to an elevator car frame in a hoistway; and a horizontal pathway extending from each one of said hoistways to a plurality of other ones of said hoistways, said pathway comprising a plurality of intersecting horizontal paths, including a plurality of first, mutually parallel paths, each extending outwardly from a corresponding one of said hoistways, and a plurality of second paths extending perpendicularly to said first paths and intersecting each of said first paths, said second paths being mutually separated sufficiently to permit one of said carriers on one of said second paths to pass the other of said carriers on the other of said second paths, said paths each comprising means for guiding said carriers therealong; and a LIM for propelling said carriers along said paths, said LIM having a primary portion and a secondary portion, one of said portions extending along said paths and the other of said portions being disposed in the shape of an orthogonal cross on said carriers in proximity with said one portion.

* * * * *